United States Patent [19]

Berry

[11] Patent Number: 4,838,492

[45] Date of Patent: Jun. 13, 1989

[54] SPRAY GUN RECIPROCATING DEVICE

[76] Inventor: Arnold R. Berry, 89 Bradley Grove, Mitchell Park, Australia, 5043

[21] Appl. No.: 186,523

[22] Filed: Apr. 27, 1988

[30] Foreign Application Priority Data

Apr. 28, 1987 [AU] Australia ..... PI1624

[51] Int. Cl.[4] ..... B05B 3/18

[52] U.S. Cl. ..... 239/752; 118/323; 134/172; 254/386

[58] Field of Search ..... 239/752; 134/172; 254/277, 360, 361, 385, 386; 118/323

[56] References Cited

U.S. PATENT DOCUMENTS

| | | | |
|---|---|---|---|
| 2,538,366 | 1/1951 | Kerwin | 134/172 |
| 2,728,238 | 12/1955 | Paasche | 239/752 |
| 3,383,046 | 5/1968 | Voegtly | 239/752 |
| 3,620,188 | 11/1971 | Schmitzer | 118/323 |
| 3,937,092 | 2/1976 | Hawkins | 118/323 |
| 4,061,311 | 12/1977 | Yamasaki et al. | 254/360 |
| 4,402,459 | 9/1983 | Berry | 239/752 |
| 4,616,782 | 10/1986 | Marietta et al. | 118/323 |

FOREIGN PATENT DOCUMENTS

| | | | |
|---|---|---|---|
| 3319665 | 12/1984 | Fed. Rep. of Germany | 118/323 |
| 304178 | 5/1971 | U.S.S.R. | 239/752 |

*Primary Examiner*—Andres Kashnikow
*Assistant Examiner*—Michael J. Forman
*Attorney, Agent, or Firm*—Townsend & Townsend

[57] ABSTRACT

A spray gun reciprocating device has a pair of tracks which are parallel to one another, each track comprises the surfaces of a square tube which are engaged by independently rotatable rollers of each of at least three roller assemblies, the rollers of each assembly having track engaging surfaces which converge towards one another, and the rollers are freely rotatable so that if one roller engages a track surface closely to its axis of rotation with the other roller, there is no skidding of the engaging surfaces.

8 Claims, 3 Drawing Sheets

SPRAY GUN RECIPROCATING DEVICE

This invention relates to a reciprocating device for a spray gun, and is particularly suitable for a spray gun of the type which utilises electrostatic forces to assist in the deposition of paint spray.

In our Australian Pat. No. 549842 (corresponding to U.S. Pat. No. 4402459 and German 3137724.6) there was described and claimed a reciprocating device which has proved to be commercially successful. That device utilised a ram having a pair of pressure accumulators each containing oil at its lower portion and air in its upper portion, conduits connecting at the lower portions with respective ends of an hydraulic cylinder, and compressed air operable to alternatively impose pressure on the oil of the pressure accumulators, a pair of sprockets on the ram rod, a chain extending from a first anchor on a frame and a second anchor on the frame, and a spray gun carrier guided for reciprocating movement and secured to an intermediate portion of the chain.

As said, this equipment has proved to be commercially successful and has been widely used, but is nevertheless subject to a number of disabilities.

BACKGROUND OF THE INVENTION

Experience has indicated that by far the most difficult problem encountered is to achieve a free smooth movement of the spray gun, but this can be interefered with if the spray gun varies its speed of movement as it is guided for movement along tracks.

If a track comprises a number of different track members as in our aforesaid patent, it is difficult to achieve an accurate gauging between the surfaces which are engaged by the carriage rollers, and for that reason the cost is high. If however, a single track is used, for example a length of square tubing, there is not sufficient accuracy of surface to avoid irregular movement of a carriage if the rollers are constructed in accordance with known art (for example V groove rollers) but even if the surfaces are machined and V groove rollers are used, uneven movement can still result due to the fact that the outer surface of one roller groove may temporarily engage a portion of the track surface, while the inner surface may frequently engage another portion but will be rotating at a different speed from the outer surface so that a moment is imparted to the spray gun which has the same effect as varying the speed of travel.

The main object of the invention is therefore to provide improvements whereby the carriage movement of a spray gun reciprocating device will be very smooth, and this is primarily effected by utilising a pair of independently rotating rollers of each of a plurality of roller assemblies on a carriage with track engaging surfaces converging towards one another.

If use is made of the "air over oil" fluid to operate a piston/cylinder assembly for moving a carriage, with the end of the travel when the reciprocating device reverses, there is a large volume of air to be quickly discharged and this can result in "icing-up" of the air valve. This in turn will reduce the rate of discharge and cause a slow reversal of movement of the carriage which again will interfere with smooth operation of a spray gun, and in order to reduce this problem in this invention there is provided an expansion chamber connected to the air valves so that discharge air exhausts firstly into the expansion chamber before being released.

BRIEF SUMMARY OF THE INVENTION

A spray gun reciprocating device has a pair of tracks which are parallel to one another, each track comprises the surfaces of a square tube which are engaged by independently rotatable rollers of each of at least three roller assemblies, the rollers of each assembly having track engaging surfaces which converge towards one another, and the rollers are freely rotatable so that if one roller engages a track surface closer to its axis of rotation that the other roller, there is no skidding of the engaging surfaces.

More specifically, the invention consists of a pair of tracks secured to the frame to be vertical and spaced from but parallel to each other, the cross-sectional shape of each track being rectangular, two carriages each guided by a plurality of roller assemblies for movement along a respective said track, each roller assembly comprising three co-axial but independently rotatable roller portions which engage respective surfaces of said track, gun mounting means on the first said carriage, a piston/cylinder assembly operatively coupling the second said carriage to the frame, and a chain multiplier coupling said carriages such that actuation of the piston/cylinder assembly effects increased movement of the first said carriage.

BRIEF SUMMARY OF THE DRAWINGS

An embodiment of the invention is described hereunder in some detail with reference to and is illustrated in the accompanying drawings in which.

Figure 1:
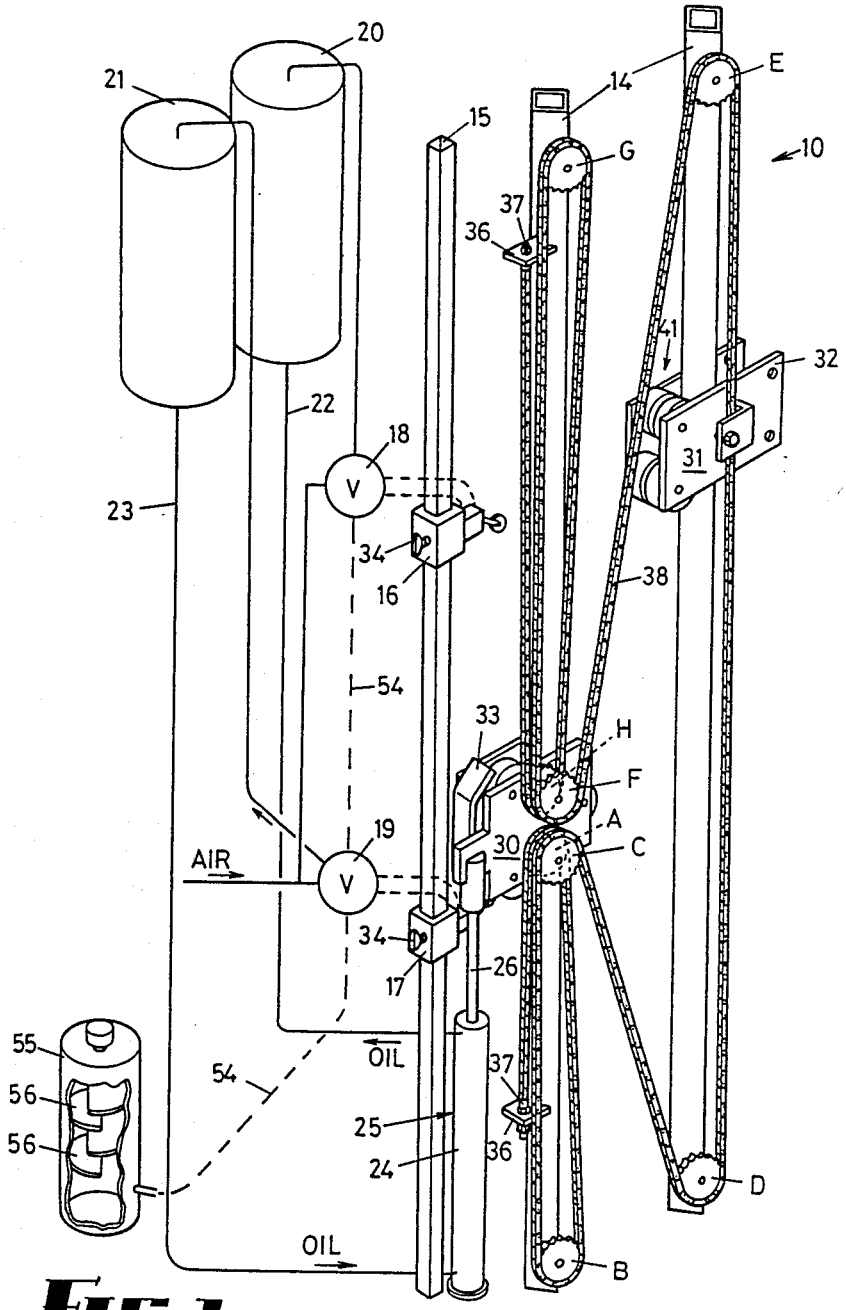
FIG. 1 is a schematic arrangement of the track carriages and valve arrangement of a spray gun reciprocating device.
Figure 2:
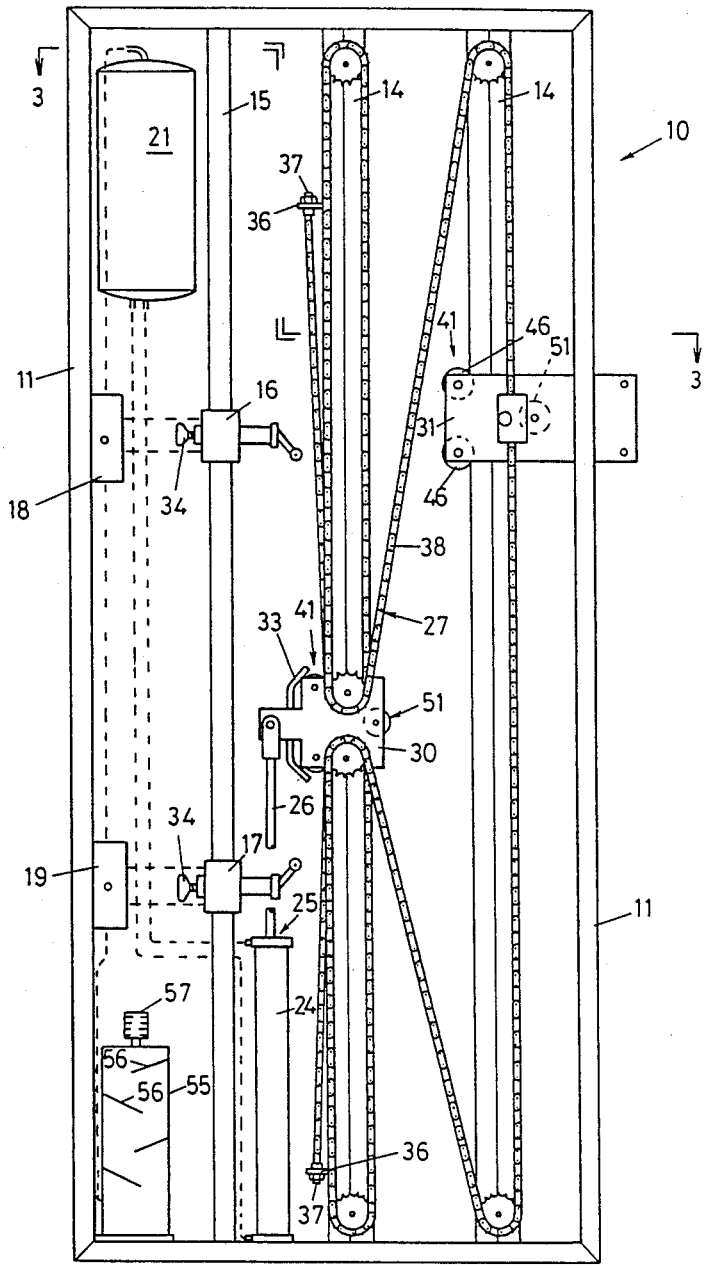
FIG. 2 is a partly schematic front elevation of the device.
Figure 3:
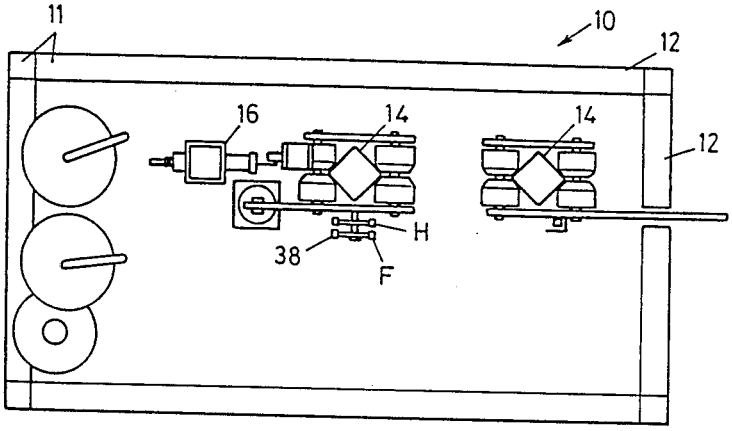
FIG. 3 is a section taken on line 3—3 of FIG. 2, and, FIG. 4 is a section showing a square tubular track engaged by independently rotatable rollers of a carriage.

A spray gun reciprocating device 10 comprises a frame 11 having a plurality of sheet metal side walls 12 welded thereto so that the frame and side walls constitute a rigid assembly.

Two spaced parallel vertical tracks 14, each of square section tubing, form portion of the frame and extend between the upper and lower ends of the device, and are parallel with one another, and also parallel with the tracks 14 is an air valve carrying bar 15. The bar 15 carries on it two pilot air valves 16 and 17 which are coupled to double acting main valves 18 and 19 respectively and these main valves 18 and 19 when actuated by the pilot valves 16 and 17 cause air flow into the upper ends of oil reservoirs 20 and 21, and these respectively are connected by oil conduits 22 and 23 to the upper and lower ends of a cylinder 24 of a piston cylinder assembly 25.

The tracks 14 carry respective carriages 30 and 31, the carriage 30 being coupled to the piston rod 26 of the assembly 25, and being coupled by a chain multiplier 27 to the carriage 31. The carriage 31 carries on it a gun mounting plate 32 shaped and configured to carry a spray gun, while the other carriage 30 has on it a shoe 33 which will actuate the respective valves 16 and 17 at the ends of the stroke of the piston rod 26. The pilot valves 16 and 17 are each adjustable along the carrying bar 15 and can be located by respective locking screws 34. The track 14 on which carriage 30 is movable has on it a pair of lugs 36 each of which carries securing means comprising an adjacent screw and nut assembly 37 by which a chain 38 can be tensioned and secured to the track 14, the chain 38 of the chain multiplier 27 passing over the pulleys A (carriage 30), B (track 14), C (carriage 30), D (gun track 14), E (gun track 14 upper end), back to sprocket F (carriage 30), G (upper end of left hand track 14), H (carriage 30), and back up to the upper adjacent screw 37 on the left hand track 14, the chain being secured to plate 32 to provide a 3 to 1 movement of carriage 31 with respect to carriage 30.

Figure 4:
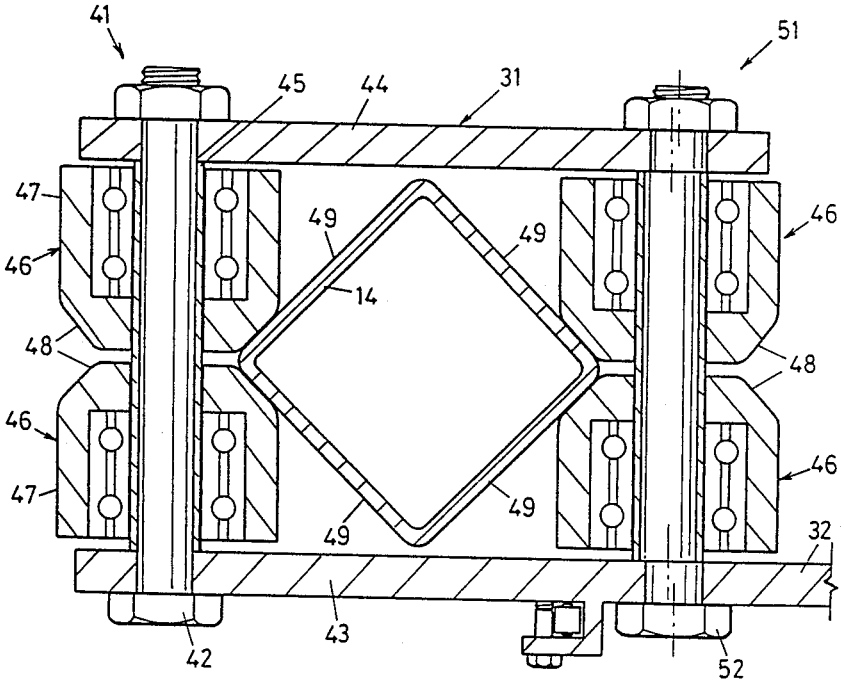

Reference is made to FIG. 4 which illustrates to a larger scale than the other Figs., details of the carriage 31, the track 14 and two roller assemblies 41. The left hand roller assembly 41 comprises a bolt 42 extending between and through cheek plates 43 and 44, and through a spacer tube 45 which separates the cheek plates. There are two rollers 46 each of which has a parallel portion 47 and a track engaging surface 48. The track engaging surface 48 of each roller converges towards the track engaging surface of the other so that these surfaces 48 engage outer surfaces 49 of a square section tubular track 14, each surface 49 being inclined at 45° to the axis of rotation of the rollers 46. In all instances the rollers 46 are independently rotatable but their track engaging surfaces are slightly convex as shown so that they engage over small areas of the tracks 14, thereby avoiding skidding or scuffing which would take place if the track engaging surfaces were truly conical. Since the rollers are independently rotatable, each can engage different portions of a track without causing scuffing of the other surface. This arrangement proves so successful that it is not necessary for the outer track surfaces 49 to be machined, and even if left in the as rolled state of tubes, the gun movement is found to be smooth and free of speed variations or rocking movement. Each carriage 30 and 31 comprises three roller assemblies each with two rollers 46, and FIG. 4 illustrates the right hand roller assembly 51 which is similar to the roller assemblies 41 excepting that the bolt 52 is eccentrically carried by the cheek plates 43 and can be so adjusted with respect thereto as to minimise the clearance between the track engaging surfaces 48 and the rollers 46, and the upper surfaces 49 of the track 14. This further assists in achieving smooth movement of the carriage along the carriage 14.

In its essential respects, carriage 30 is similar to the carriage 31 illustrated in FIG. 4.

Reference is now made to the control of air, and as said above, when either of the valves 18 or 19 is actuated by its pilot valve 16 or 17, a large amount of air is released because of the volume above the oil in the reservoirs 20 and 21. This is released or passed through an air exhaust conduit 54 (connected to both valves 18 and 19) and into an air exhaust chamber 55 which contains baffles 56. These baffles 56 have the effect of reducing the amount of exhausted liquid (for example oil, or water from the atmosphere) and the then expanded air is released to atmosphere through a muffler 57.

The claims defining the invention are as follows:

1. An improved spray gun reciprocating device comprising a frame, said frame having a pair of vertical tracks spaced from but parallel to each other, each said track comprising two flat track surfaces defining an angle between one another, two carriages each comprising a plurality of roller assemblies for movement along a respective said track, each roller assembly comprising two co-axial but independently rotatable roller portions which engage respective said track surfaces and rotate about an axis which is at an angle to track surfaces, gun mounting means on a first said carriage, a piston/cylinder assembly extending between the second said carriage and the frame, and a chain multiplier comprising sprockets on the frame and sprockets on the second said carriage, a chain extending over said sprockets, and securing means securing the chain ends with respect to the frame, and further securing means securing the chain intermediate its ends to said first carriage thereby coupling said carriages such that actuation of the piston/cylinder assembly effects consequential movement of the second said carriage and increased movement of the first said carriage.

2. An improved spray gun reciprocating device comprising a frame, said frame having a pair of vertical tracks and spaced from but parallel to each other, the cross-sectional shape of each said track being rectangular and each track having four flat track surfaces, two carriages movable along respective said tracks, each said carriage comprising two roller assemblies on one side of its track and one roller assembly on the other side thereof, each said roller assembly comprising a shaft and two co-axial but independent roller portions rotatable on the shaft, each roller portion having a track engaging surface which converges towards the other roller portion of its assembly, is convexly curved in cross-section, and engages a said flat surface of a said track, gun mounting means on a first said carriage, a piston/cylinder assembly operatively coupling the second said carriage to the frame, a chain multiplier comprising sprockets on the frame and sprockets on the second said carriage, a chain extending over said sprockets, and securing means securing the chain ends with respect to the frame, and further securing means securing the chain intermediate its ends to said first carriage thereby coupling said carriages such that actuation of the piston/cylinder assembly effects consequential movement of the second said carriage and increased movement of the first said carriage, and pressure fluid means coupled to the piston/cylinder assembly for so effecting said actuation as to cause reciprocating movement of the carriages.

3. An improved spray gun reciprocating device according to claim 2 wherein each said roller assembly comprises a pair of cheek plates one on each side of a said track, each shaft extending between the cheek plates of a said pair, and a pair of co-axial bearings carried by each roller and journalling that roller for rotation with respect to its shaft.

4. An improved spray gun reciprocating device according to claim 3 wherein one of said shafts comprises a bolt which extends between and through its cheek plates, said bolt having threaded ends projecting from a cheek plate, and a locking nut on the threaded end, said bolt having an eccentric portion which carries said co-axial bearings and being adjustable so as to apply a pre-load between its rollers and track.

5. An improved spray gun reciprocating device according to claim 2 wherein each said track is a square section tube.

6. An improved spray gun reciprocating device according to claim 2 wherein each said roller track engaging surface is convex.

7. An improved spray gun reciprocating device according to claim 2 wherein said pressure fluid means comprises two double acting air valves actuated by a second said carriage reaching the end of its stroke in each respective direction, two oil reservoirs under the pressure influence of air when introduced thereinto by actuation of respective said air valves, oil conduits connecting the lower ends of the respective reservoirs to the ends of the cylinder of said piston/cylinder assembly, air exhaust chamber, and an air exhaust line from said valves, extending from said valves to said chamber.

8. An improved spray gun reciprocating device according to claim 7 wherein said exhaust chamber comprises baffles and an exhaust muffler.

* * * * *